United States Patent [19]

Thornburgh

[11] 4,087,965

[45] May 9, 1978

[54] ENGINE CONTROL ASSEMBLY

[75] Inventor: William F. Thornburgh, Rochester, Mich.

[73] Assignee: General Motors Corporation, Detroit, Mich.

[21] Appl. No.: 748,689

[22] Filed: Dec. 9, 1976

[51] Int. Cl.[2] ..... F01N 3/10; F02M 25/06

[52] U.S. Cl. ..... 60/277; 60/278; 60/290; 123/119 A; 236/87

[58] Field of Search ..... 60/277, 289, 290, 278; 236/87, 101 A; 123/119 A

[56] References Cited

U.S. PATENT DOCUMENTS

| | | | |
|---|---|---|---|
| 3,236,044 | 2/1966 | Ruge | 60/289 |
| 3,364,909 | 1/1968 | Mick | 60/290 |
| 3,591,961 | 7/1971 | Woodward | 60/290 |
| 3,700,165 | 10/1972 | Beehler | 236/101 A |
| 4,016,853 | 4/1977 | Bible | 236/87 |

*Primary Examiner*—Douglas Hart
*Attorney, Agent, or Firm*—C. K. Veenstra

[57] ABSTRACT

In an engine having a pump for delivering air to the exhaust system to support oxidation of exhaust gases, a valve opens when air delivered by the pump exceeds a selected temperature to bleed air from the pump into the vacuum chamber of a diaphragm operated valve. In one embodiment the valve diverts air from the exhaust system to relieve the backpressure on the pump, while in another embodiment the valve closes an exhaust gas recirculation passage to improve efficiency of operation.

4 Claims, 2 Drawing Figures

ENGINE CONTROL ASSEMBLY

Figure 1:
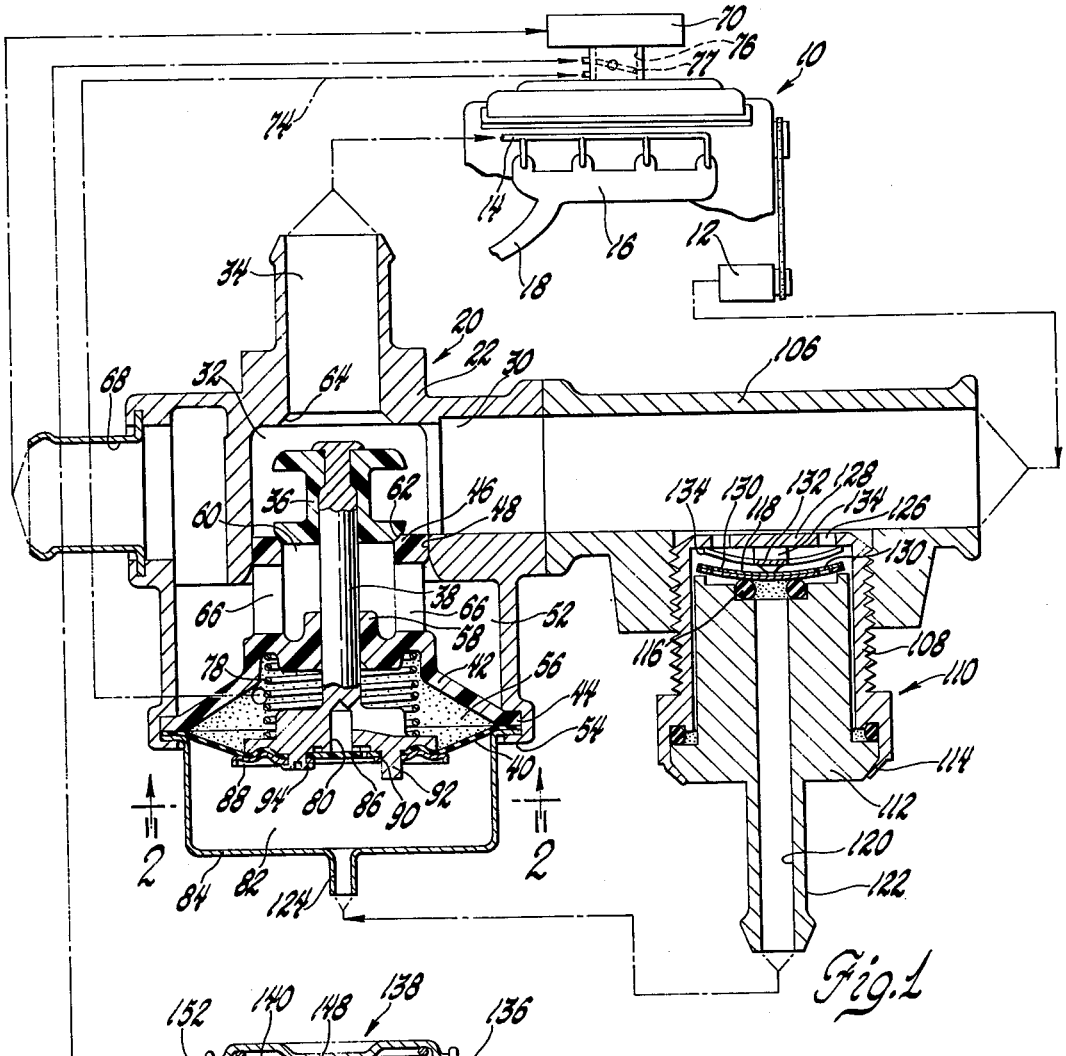

This invention relates to an engine control assembly which responds to the temperature of the air supplied from an air pump to an engine exhaust system.

To control emission of internal combustion engine exhaust gas hydrocarbons and carbon monoxide, air is frequently delivered either to the engine exhaust ports or to some other portion of the engine exhaust system to support oxidation within the exhaust system. In such engines, it is sometimes necessary to divert some or all of the air away from the exhaust system during certain engine operating conditions such as initial deceleration, sustained high speed operation, high air pump discharge flow rate or pressure, or elevated engine, coolant, exhaust gas or exhaust gas catalytic converter temperature.

This invention provides an alternative to the controls already known. In the control assembly provided by this invention, the temperature of the air discharged by the air pump is sensed; when that temperature exceeds a selected value such as 180° F, for example, air is bled from the air pump discharge line to a diaphragm which opens a valve to allow the remainder of the air discharged from the pump to be diverted away from the exhaust system. It will be appreciated that since elevated pump discharge temperatures occur during high speed operation when emission of hydrocarbons and carbon monoxide is not a significant problem, diverting air away from the exhaust system under such conditions relieves the backpressure on the pump to preserve its useful life and minimize its power demands without adversely affecting engine emissions.

Advantageously, this control assembly is combined with the conventional diverter valve which diverts air away from the exhaust system upon a sudden decrease in manifold pressure such as that which accompanies initial deceleration; such a combination allows air to be diverted both during deceleration and during operation with high pump discharge temperatures.

It will be appreciated that instead of, or in addition to, controlling a system for delivering air to the engine exhaust system, the control assembly provided by this invention may control other systems such as a system for recirculating exhaust gases to the engine. In such an embodiment, when the temperature of the air delivered by the pump exceeds a selected level, air is bled from the pump discharge line to a diaphragm which closes a valve in the exhaust gas recirculation line. Since the elevated pump discharge temperatures occur during high speed operation when formation of oxides of nitrogen is not a significant problem, recirculation of exhaust gases may be obstructed under these conditions to improve engine fuel economy without adversely affecting engine emissions.

Figure 2:
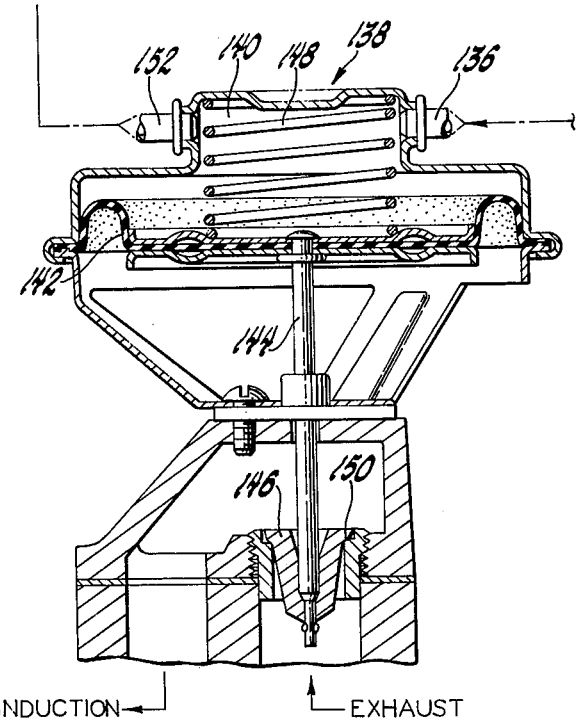
Figure 2:
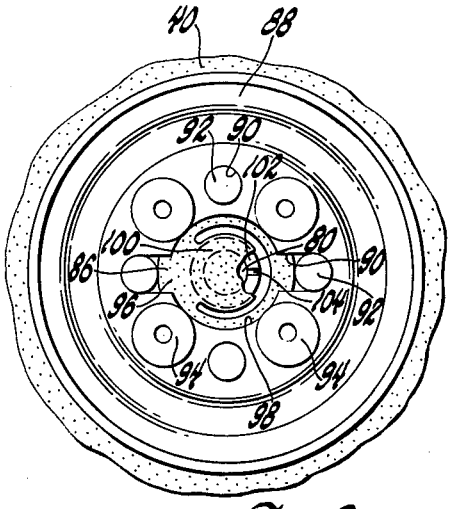

The details as well as other objects and advantages of this invention are set forth in detail in the remainder of the specification and are shown in the drawings in which:

FIG. 1 schematically illustrates application of this invention to control of air flow to the engine exhaust system and to control of exhaust gas recirculation; and FIG. 2 is a view along line 2—2 of FIG. 1, enlarged to illustrate the details of a check valve within the air flow control unit.

Referring first to FIG. 1, an internal combustion engine 10 has an air pump 12 which supplies air through an air flow line or conduit 14 to the exhaust manifold 16 or to another portion of the exhaust system 18. The air supports oxidation of exhaust gas hydrocarbons and carbon monoxide in the exhaust system.

An air flow control unit 20 is mounted between pump 12 and flow conduit 14. Its housing 22 has a lateral inlet 30 extending to a valve chamber 32. Air is received from air pump 12 through inlet 30 and is discharged through a main outlet 34 to air flow conduit 14.

A valve member 36 is disposed in valve chamber 32 and secured to the upper end of a valve stem 38. The lower end of valve stem 38 is secured to a diaphragm 40 which closes the lower end of housing 22.

A fiberglass reinforced nylon insert member 42 is secured about its lower rim 44 between diaphragm 40 and housing 22. The upper rim 46 of insert 42 is pressed into a bore 48 of housing 22.

The press fit of rim 46 in bore 48 prevents direct leakage of air from valve chamber 32 to an annular chamber 52 defined between insert 42 and housing 22. The lower rim 54 of housing 22 is spun over rim 44 of insert 42 and the peripheral edge of diaphragm 40 to seal a chamber 56, defined between diaphragm 40 and insert 42, from annular chamber 52. A guide portion 58 of insert 42 fits closely about stem 38 both to support and guide stem 38 and to prevent leakage of air from chamber 52 into chamber 56.

Insert 42 has a cylindrical recess 60 surrounding guide portion 58. The upper periphery of recess 60 defines a bypass valve seat 62 which is engaged by the lower portion of valve member 36. When valve stem 38 is displaced upwardly, valve member 36 will be moved from valve seat 62 and will engage a valve seat 64 surrounding main outlet 34. This will prevent air flow from inlet 30 to main outlet 34 and will divert that air flow into recess 60 from which is passes into annular chamber 52 through a pair of diametrically opposed apertures 66. The air then flows from chamber 52 through a fitting 68 to the engine air cleaner 70.

A vacuum conduit 74 extends from the engine induction system 76 downstream of the throttle 77 to chamber 56. During engine deceleration, manifold vacuum rises abruptly, and the vacuum in chamber 56 increases correspondingly. Diaphragm 40 then lifts valve stem 38 against the bias of spring 78, retracting valve member 36 against seat 64 to interrupt air flow from pump 12 to exhaust manifold 16 and thus prevent backfiring in the exhaust system.

A passage 80 extends through the lower portion of valve stem 38 to connect vacuum chamber 56 with a chamber 82 defined between diaphragm 40 and a lower cup 84. A check valve 86 is disposed in passage 80 to regulate flow from chamber 82 to chamber 56; check valve 86 thus controls the time required to reduce the pressure in chamber 82 to the point where spring 78 will advance diaphragm 40, valve stem 38, and valve member 36 to the position shown.

The details of check valve 86 are shown in FIG. 2. A washer member 88 is disposed under diaphragm 40 and has a plurality of apertures 90 which receive legs 92 formed on the lower portion of valve stem member 38. Four of these legs are riveted, as at 94, to retain washer 88 against valve stem member 38.

The outer rim 96 of check valve member 86 is supported by the inner rim 98 of washer 88. A central flap 100 of check valve 86 overlies an annular valve seat 102 formed at the base of stem member 38. A notch 104 is coined in seat 102. During the period when manifold vacuum in vacuum chamber 56 is increasing, flow from chamber 82 through passage 80 to chamber 56 is restricted to pass through notch 104. Thus, the volume of chamber 82 and the size of notch 104 determine the time required for the pressure in chamber 82 to be reduced to the point where spring 78 will lower diaphragm 40, stem member 38 and valve member 36 to the position shown. During a period of increasing pressure in chamber 56, central flap 100 will be pushed downwardly to allow unrestricted flow from chamber 56 through passage 80 to chamber 82 and thus permit immediate return of diaphragm 40, stem member 38 and valve member 36 to the position shown.

A fitting 106 disposed between air flow control unit 20 and air pump 12 carries the threaded housing 108 of a temperature responsive valve unit 110. A body 112 is retained within housing 108 by crimping a flange 114. Body 112 carries an O-ring valve seat 116 which receives a cupped bimetal thermostatic disc 118. Disc 118 controls flow through a passage 120 in body 112 which connects through a fitting 122 to a fitting 124 on the lower cup 84 of air flow control unit 20.

During operation at temperatures below 180° F, for example, the manifold vacuum in chamber 82 is transmitted through fittings 124 and 122 to hold disc 118 against O-ring 116. When the temperature of the air delivered by air pump 12 increases above 180° F, for example, thermostatic disc 118 snaps from convex toward O-ring 116 to concave toward O-ring 116. Air may then flow from inlet 30 through a plurality of apertures 126 in the base 128 of housing 108 and apertures 130 in disc 118 into passage 120 and thus into chamber 82 of air flow control unit 20. The pump discharge pressure in the chamber 82 below diaphragm 40 then cooperates with the manifold vacuum in chamber 56 above diaphragm 40 to raise stem 38 against the bias of spring 78 and engage valve member 36 with valve seat 64. The entire air delivery from pump 12 is thus diverted through valve seat 62 away from exhaust manifold 16 and passes through recess 60, apertures 66, annular chamber 52 and fitting 68 to the engine air cleaner 70 which thus acts as a pump discharge silencer. The backpressure created through valve seat 62, recess 60, apertures 66, chamber 52, fitting 68 and air cleaner 70 is substantially less than the backpressure created through valve seat 64, flow conduit 14 and exhaust system 18, and the backpressure on pump 12 is accordingly relieved to prolong the useful life of the pump. Other advantages also may be realized in terms of reduced exhaust system temperatures and improved engine efficiency.

When the air pump discharge temperature drops below 165–170° F, for example, thermostatic disc 118 snaps back from concave toward O-ring 116 to convex toward O-ring 116 and a biasing member 132 having several spring legs 134 pushes thermostatic disc 118 back against O-ring 116.

Instead of, or in addition to, bleeding air to air flow control unit 20, temperature responsie valve unit 110 may bleed air to the fitting 136 of an exhaust gas recirculation valve assembly 138. Fitting 136 opens into a vacuum chamber 140 above a diaphragm 142. Diaphragm 142 is connected to a stem 144 which extends to a valve pintle 146. A spring 148 biases diaphragm 142 downwardly to engage valve pintle 146 with a valve seat 150.

A second fitting 152 subjects diaphragm 142 to the vacuum signals created in induction passage 76 adjacent throttle 77. During open throttle operation, diaphragm 142 is drawn upwardly against the bias of spring 148, retracting valve pintle 146 away from valve seat 150 to allow recirculation of exhaust gases from the exhaust system to the induction system.

However, during sustained high speed operation when air pump discharge temperatures exceed 180° F, for example, temperature responsive valve unit 110 bleeds air into chamber 140. In consequence, spring 148 advances diaphragm 142, engaging valve pintle 146 with valve seat 150 to inhibit recirculation of exhaust gases. The reduction in the amount of exhaut gases recirculated to the combustion chamber allows more effective combustion and thus improves the engine fuel economy.

It will be appreciated, of course, that if control unit 110 bleeds air both to air flow control unit 20 and to exhaust gas recirculation valve assembly 138, an appropriate check valve may be used in fitting 136 and/or fitting 124 to prevent confusion of vacuum signals between chambers 82 and 140.

The embodiments of the invention in which an exclusive property or privilege is claimed are defined as follows:

1. In an internal combustion engine having an exhaust system for exhaust gas flow from the engine and a pump for delivering air to said exhaust system to support oxidation of exhaust gases therein: an engine control assembly comprising an element movable between advanced and retracted positions in response to at least one engine operating parameter for controlling engine operation in accordance with that parameter, and means responsive to the temperature of the air delivered by said pump for causing said element to move to said advanced position irrespective of said parameter to thereby enhance operation of the engine.

2. In an internal combustion engine having an exhaust system for exhaust gas flow from the engine and a pump for delivering air to said exhaust system to support oxidation of exhaust gases therein: an engine control assembly comprising an element movable between advanced and retracted positions for controlling engine operation, means for creating a subatmospheric pressure signal which varies with engine operation, a member responsive to said pressure signal for moving said element to said advanced position when said pressure signal is above a certain level and to said retracted position when said pressure signal is below the certain level, and a valve responsive to the temperature of the air delivered by said pump for delivering air from said pump to said member to cause said member to move said element to said advanced position when said temperature is above a selected level.

3. In an internal combustion engine having an exhaust system for exhaust flow from the engine and a pump for delivering air to said exhaust system to support oxidation of exhaust gases therein: an air flow control valve assembly comprising means defining an inlet for receiving air from said pump, a main outlet for delivering air to said exhaust system, and a bypass outlet for diverting air away from said exhaust system, a valve member cooperating with said bypass outlet for alternatively directing air from said inlet through said main outlet and permitting air flow from said inlet through said bypass outlet, and means responsive to the temperature of the air received in said inlet for positioning said valve member to direct air through said main outlet when said temperature is below a selected level and to permit air flow through said bypass outlet when said temperature is above the selected level, and wherein air flowing through said bypass outlet encounters substantially lower flow resistance than air directed through said main outlet whereby the work done by said pump is limited to thereby prolong the useful life of said pump.

4. In an internal combustion engine having an induction system for air flow to the engine, a throttle in said induction passage controlling air flow therethrough, an exhaust system for exhaust gas flow from the engine, and a pump for delivering air to said exhaust system to support oxidation of exhaust gases therein: an air flow control valve assembly comprising means defining an inlet for receiving air from said pump, a main outlet for delivering air to said exhaust system, and a bypass outlet for diverting air away from said exhaust system, a valve member cooperating with said bypass outlet for alternatively directing air from said inlet through said main outlet and permitting air flow from said inlet through said bypass outlet, a spring biasing said valve member to direct air from said inlet through said main outlet, a pressure responsive diaphragm connected to said valve member, means subjecting one side of said diaphragm to the subatmospheric pressure in said induction system downstream of said throttle whereby upon a certain decrease in induction passage pressure said diaphragm may overcome the bias of said spring and position said valve member to permit air flow from said inlet through said bypass outlet, and means responsive to the temperature of the air received in said inlet for subjecting the other side of said diaphragm to the pressure in said inlet whereby upon a selected increase in air temperature said diaphragm may overcome the bias of said spring and position said valve member to permit air flow from said inlet through said bypass outlet.

* * * * *